US009508294B2

(12) United States Patent
He

(10) Patent No.: US 9,508,294 B2
(45) Date of Patent: Nov. 29, 2016

(54) METHOD OF ADJUSTING FLICKER OF LIQUID CRYSTAL PANEL

(71) Applicant: Shenzhen China Star Optoelectronics Technology Co., Ltd., Shenzhen, Guangdong (CN)

(72) Inventor: Jian He, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/426,377

(22) PCT Filed: Oct. 14, 2014

(86) PCT No.: PCT/CN2014/088524

§ 371 (c)(1),
(2) Date: Mar. 5, 2015

(87) PCT Pub. No.: WO2016/041224

PCT Pub. Date: Mar. 24, 2016

(65) Prior Publication Data

US 2016/0267855 A1 Sep. 15, 2016

(30) Foreign Application Priority Data

Sep. 17, 2014 (CN) ..... 2014 1 0475209

(51) Int. Cl.
*G09G 3/36* (2006.01)

(52) U.S. Cl.
CPC ..... *G09G 3/36* (2013.01); *G09G 2320/029* (2013.01); *G09G 2320/0247* (2013.01)

(58) Field of Classification Search
CPC ..... G09G 2320/029; G09G 2320/0247; G09G 3/36–3/3696; G02F 1/133
See application file for complete search history.

(56) References Cited

U.S. PATENT DOCUMENTS

| | | | | |
|---|---|---|---|---|
| 6,809,746 | B2 * | 10/2004 | Whittington | G09G 3/006 345/690 |
| 2006/0145986 | A1 * | 7/2006 | Oh | G09G 3/006 345/92 |
| 2007/0057975 | A1 * | 3/2007 | Oh | G09G 3/3648 345/690 |
| 2009/0213284 | A1 * | 8/2009 | Liao | G09G 3/3607 349/33 |
| 2012/0105510 | A1 * | 5/2012 | Nakanishi | G09G 3/3655 345/690 |
| 2015/0213769 | A1 * | 7/2015 | Shin | G09G 3/3607 345/690 |

* cited by examiner

*Primary Examiner* — Dwayne Bost
*Assistant Examiner* — Ivelisse Martinez Quiles
(74) *Attorney, Agent, or Firm* — Andrew C. Cheng

(57) ABSTRACT

The present invention provides a method of adjusting flicker of the liquid crystal panel, comprising: providing a Nth liquid crystal panel to be implemented with flicker adjustment; counting a mathematical expectation μ and a standard deviation σ of the optimized voltage values of common electrodes of 1st to N−1th liquid crystal panels; setting an initial range (VL, VH) of adjusting voltage values of common electrodes, wherein VL=μ−Mσ, VH=μ+Mσ; showing a flicker image, and writing VH, VL, (VH+VL)/2 into a random access memory of the Nth liquid crystal panel one by one, and measuring corresponding flicker values; determining whether the flicker value corresponding to (VH+VL)/2 is a minimum among the three flicker values in the fourth step; if it is not the minimum, adjustment is accomplished; if it is the minimum, the adjustment is proceeded; writing the voltage values of common electrodes in the initial range (VL, VH) into the random access memory one by one and from low to high, and measuring corresponding flicker values; selecting a voltage value of common electrode corresponding to a minimum of the flicker values to be written into a read only memory of the Nth liquid crystal panel, and the adjustment is accomplished.

8 Claims, 7 Drawing Sheets

| range | probability |
|---|---|
| (μ-σ, μ+σ) | 0. 6827 |
| (μ-2σ, μ+2σ) | 0. 9545 |
| (μ-3σ, μ+3σ) | 0. 9973 |
| (μ-4σ, μ+4σ) | 0. 99994 |

Fig. 6

METHOD OF ADJUSTING FLICKER OF LIQUID CRYSTAL PANEL

FIELD OF THE INVENTION

The present invention relates to a liquid crystal display technology field, and more particularly to a method of adjusting flicker of a liquid crystal panel.

BACKGROUND OF THE INVENTION

At present, a degree of flicker phenomenon always exists in the production processes of the liquid crystal modules. The over large flicker value can cause visual fatigue and discomfort of the audiences. Therefore, the flicker adjustment is mandatory to implement before liquid crystal modules before delivery to ensure the flicker level of the images in a predetermined range for promoting the view results. The Voltage of Common electrode (V-com) is a voltage value of the panel in the liquid crystal module and determined by the characteristic of the liquid crystal and the working principle of the liquid crystal module. A positive and negative bias voltage exists in the drive circuit of the liquid crystal panel. The voltage of common electrode is demanded to be set right at the center of the positive and negative bias voltage. By adjusting the voltage value of common electrode, the flicker value of the liquid crystal panel can be adjusted to be the minimum, and accordingly to make the view result of the liquid crystal panel be the best.

In the recent years, an automatic adjustment system for adjusting the flicker of the liquid crystal panel adaptable for the production line of the liquid crystal panels has come. The principle is writing the voltage values of common electrodes into the RAM (Random Access Memory) of a common electrode voltage chip from low to high with the effective ranges of the voltage values of common electrodes, and measuring one flicker value as writing each of voltage values of common electrodes, and selecting the voltage value of common electrode corresponding to the minimum of all the flicker values to be written into the ROM (Read-Only Memory) of the common electrode voltage chip to accomplish the adjustment. Such method may be much faster than the manual adjustment. Nevertheless, the amount of sequentially written voltage values of common electrodes can be more and the spent time is longer. The efficiency of the flicker adjustment is not as well as expected.

SUMMARY OF THE INVENTION

An objective of the present invention is to provide a method of adjusting flicker of the liquid crystal panel, which is capable of narrowing the adjustment range of the voltage value of common electrode to reduce the adjustment time and raise the production efficiency. Meanwhile, the abnormal panels can be screened out quickly.

For realizing the aforesaid objective, the present invention provides a method of adjusting flicker of the liquid crystal panel, comprising: Step 1, providing a Nth liquid crystal panel to be implemented with flicker adjustment, and providing optimized voltage values of common electrodes of 1st to N−1th liquid crystal panels;

The variable N is an integer larger than 10.

Step 2, counting a mathematical expectation $\mu$ and a standard deviation a of the optimized voltage values of common electrodes of 1st to N−1th liquid crystal panels;

Step 3, setting an initial range (VL, VH) of adjusting voltage values of common electrodes, and the initial range is determined by a principle of normal distribution, wherein $VL=\mu-M\sigma$, $VH=\mu+M\sigma$, and M is a positive integer;

Step 4, showing a flicker image, and writing VH, VL, (VH+VL)/2 into a random access memory of the Nth liquid crystal panel one by one, and measuring corresponding flicker values;

Step 5, determining whether the flicker value corresponding to (VH+VL)/2 is a minimum among the three flicker values in the Step 4; if it is not the minimum, the Nth liquid crystal panel is an abnormal panel to be screened out, and adjustment is accomplished; if it is the minimum, the adjustment is proceeded;

Step 6, writing the voltage values of common electrodes in the initial range (VL, VH) into the random access memory one by one and from low to high, and measuring corresponding flicker values;

Step 7, selecting a voltage value of common electrode corresponding to a minimum of the flicker values to be written into a read only memory of the Nth liquid crystal panel, and the adjustment is accomplished.

The 1st to Nth liquid crystal panels in the Step 1 are same model.

The Step 5 is proceeded according to mean value theorem.

The Step 1 of providing the optimized voltage values of common electrodes of the 1st to N−1th liquid crystal panels comprises: sequentially implementing flicker adjustment to the 1st to N−1th liquid crystal panels, and directly selecting all effective ranges to be sequentially written into the random access memory of a common electrode voltage chip of the liquid crystal panel from low to high as implementing adjustment to each of the liquid crystal panels, and measuring one flicker value as writing each of voltage values of common electrode, and selecting the voltage value of common electrode corresponding to the minimum of all the flicker values to be written into the read only memory of the common electrode voltage chip of the liquid crystal panel.

The variable N in the Step 1 is preferable to be an integer larger than 50.

The variable M in the Step 3 is smaller than 5.

The variable M in the Step 3 is preferable to be 3.

The benefits of the present invention are: the present invention applies the statistics analytic technique for setting the upper limit and the lower limit of the flicker adjustment range. By implementing statistical analysis to the optimized voltage values of common electrodes of the previously adjusted N−1 liquid crystal panels, the initial range of adjusting the optimized voltage values of common electrodes of the Nth liquid crystal panel can be determined to enormously narrow the change variation range of the voltage values of common electrodes and to promote the efficiency of the flicker adjustment so that the production efficiency is significantly raised; meanwhile, with the constant improvement of the process, the optimized voltage value of common electrode is tending towards stability, i.e. a is decreasing and the adjustment range is narrowed, too. The required time for the flicker adjustment is reduced in advance and the improvement is getting more obvious; except saving the adjustment time, the present invention is capable of quickly screening out the panels with abnormal flicker.

BRIEF DESCRIPTION OF THE DRAWINGS

The technical solution, as well as beneficial advantages, of the present invention will be apparent from the following detailed description of an embodiment of the present invention, with reference to the attached drawings.

In drawings,

FIG. 6 is a probability distribution table in different ranges of the optimized voltage values of common electrodes;

DETAILED DESCRIPTION OF PREFERRED EMBODIMENTS

In order to better understand the characteristics and technical aspect of the invention, please refer to the following detailed description of the present invention is concerned with the diagrams.

Figure 1:
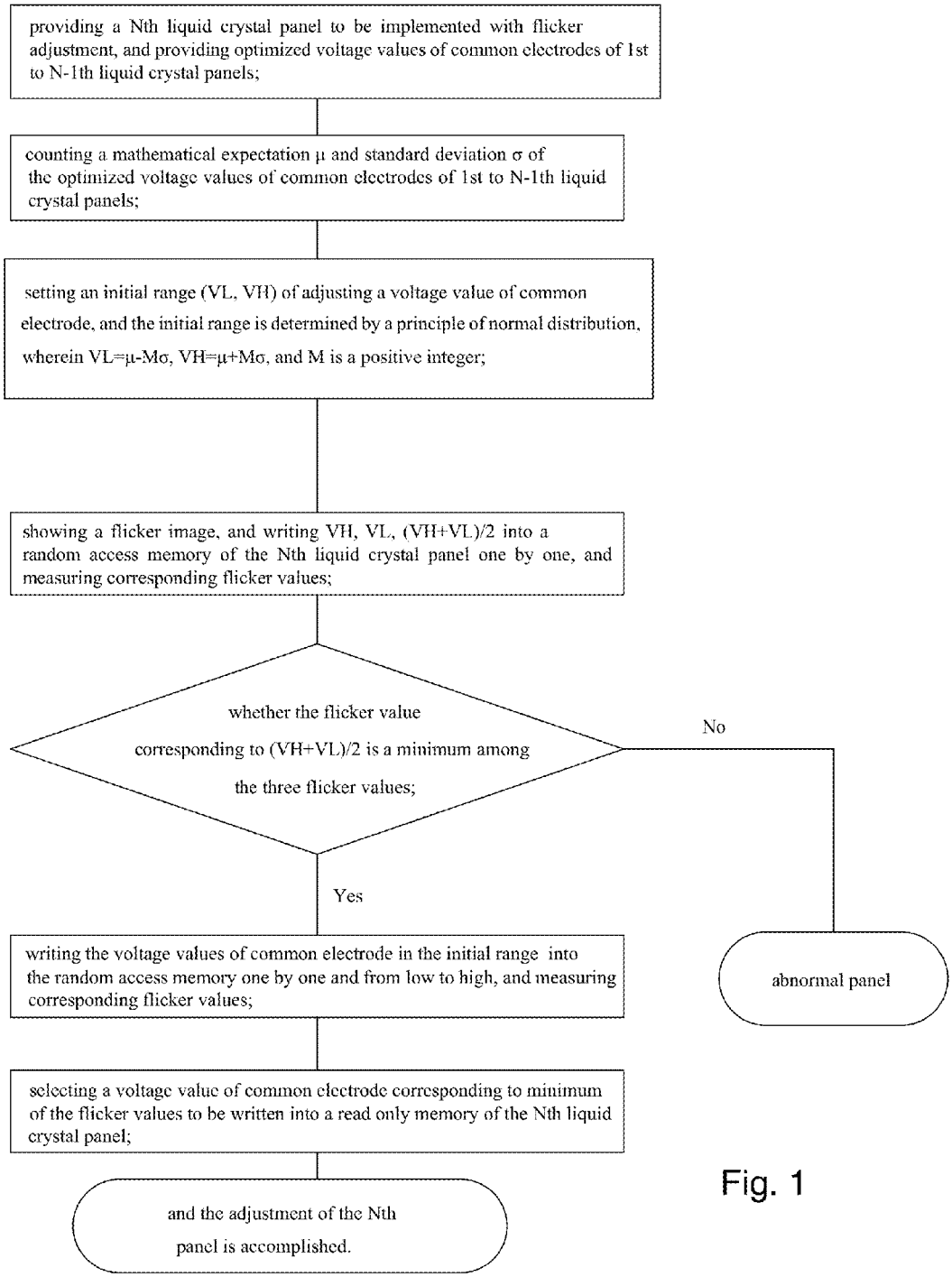
FIG. 1 is an implement flowchart of a method of adjusting flicker of the liquid crystal panel according to the present invention.

Please refer to FIG. 1. The present invention provides a method of adjusting flicker of the liquid crystal panel, comprising: Step 1, providing a Nth liquid crystal panel to be implemented with flicker adjustment, and providing an optimized voltage values of common electrodes of 1st to N−1th liquid crystal panels;

For ensuring that the adjustment initial range of the common voltage is an effective range, the 1st to N−1th liquid crystal panels in the Step 1 are demanded to be the same model;

Preferably, the variable N is an integer larger than 10, and preferably, the variable N is an integer larger than 50;

The Step 1 of providing the optimized voltage values of common electrodes of the 1st to N−1th liquid crystal panels comprises: sequentially implementing flicker adjustment to the 1st to N−1th liquid crystal panels, and directly selecting all effective ranges to be sequentially written into the random access memory of a common electrode voltage chip of the liquid crystal panel from low to high as implementing adjustment to each of the liquid crystal panels, and measuring one flicker value as writing each of voltage values of common electrode, and selecting the voltage value of common electrode corresponding to the minimum of all the flicker values to be written into the read only memory of the common electrode voltage chip of the liquid crystal panel.

Step 2, counting a mathematical expectation $\mu$ and a standard deviation a of the optimized voltage values of common electrodes of 1st to N−1th liquid crystal panels;

Step 3, setting an initial range (VL, VH) of adjusting voltage values of common electrodes, and the initial range is determined by a principle of normal distribution, wherein $VL=\mu-M\sigma$, $VH=\mu+M\sigma$, and M is a positive integer;

The variable M in the Step 3 is smaller than 5 and is preferable to be 3.

Figure 3:
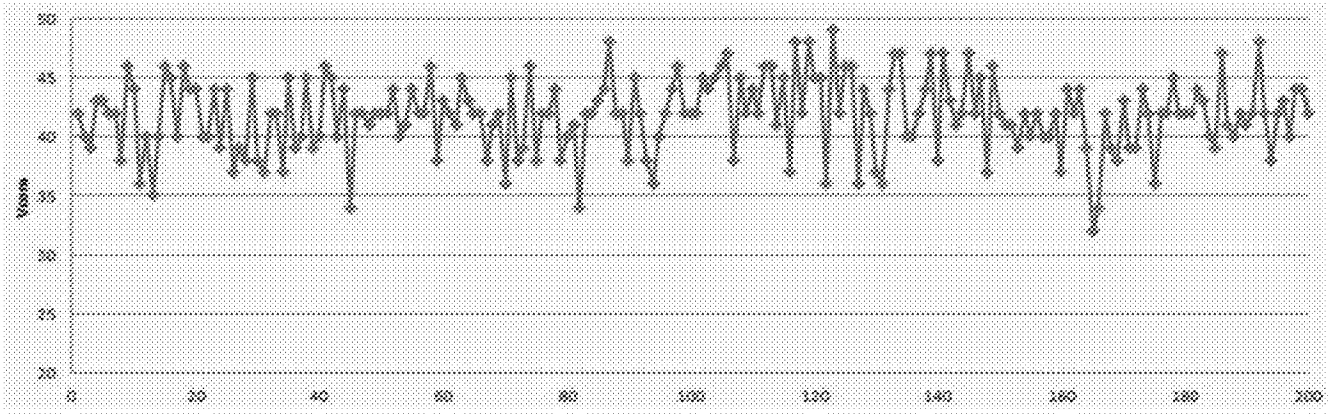
FIG. 3 is a distribution line chart of the optimized voltage values of common electrodes of 200 pieces of liquid crystal panels.
Figure 4:
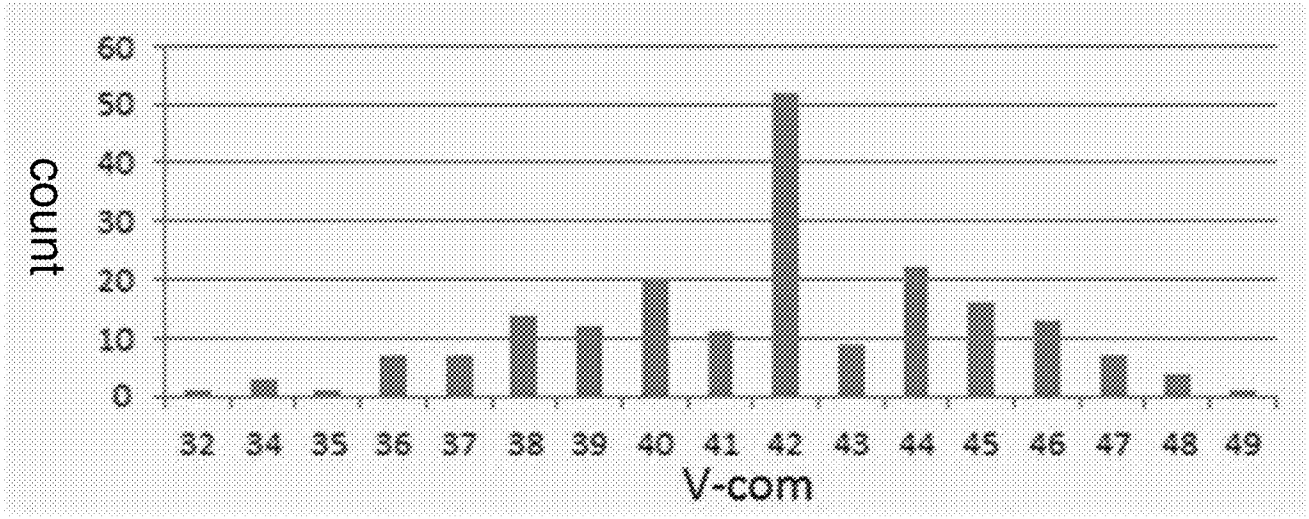
FIG. 4 is a count bar chart of the optimized voltage values of common electrodes of 200 pieces of liquid crystal panels.
Figure 5:
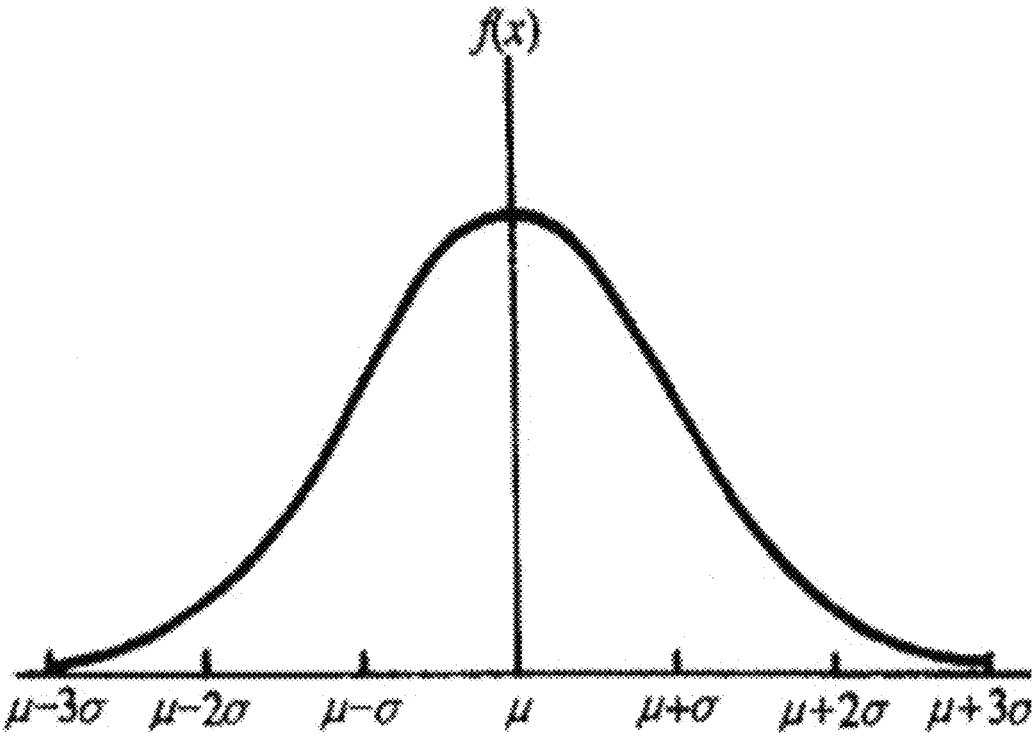
FIG. 5 is a normal distribution curve of the optimized voltage values of common electrodes.
Figure 7:
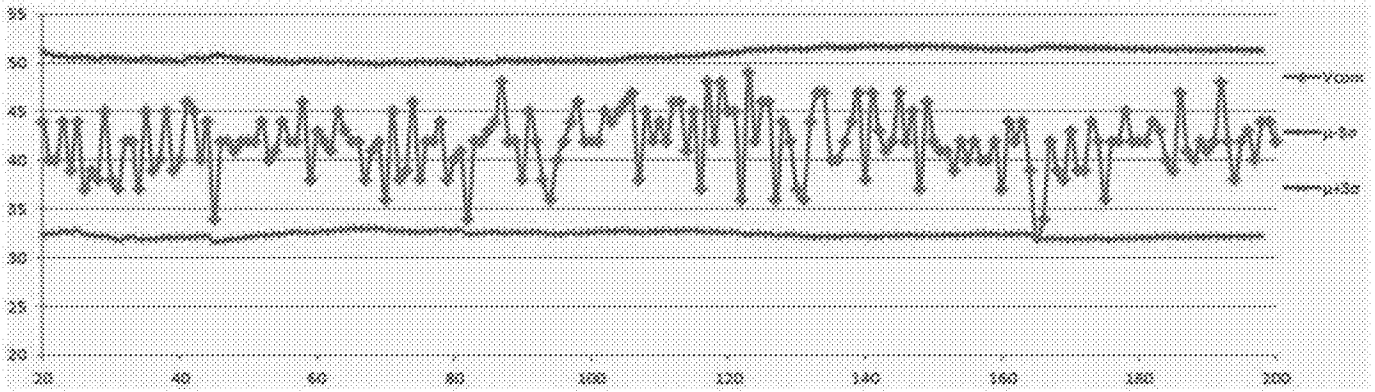
FIG. 7 is a curve diagram of an adjustment initial range of the voltage values of common electrodes from the 20th liquid crystal panel to the 200th liquid crystal panel.

Please refer from FIG. 3 to FIG. 6, which statistics has been implemented with 200 pieces of liquid crystal panels of the same model. FIG. 3 depicts a distribution line chart of the optimized voltage values of common electrodes of 200 pieces of liquid crystal panels. The appearing number of every optimized voltage value of common electrode has been counted to depict FIG. 4 which shows a count bar chart of actually adjusting the optimized voltage values of common electrodes of 200 pieces of liquid crystal panels. As shown in FIG. 4, the distribution of the optimized voltage values of common electrodes meets the normal distribution. Therefore, the adjustment initial range of the voltage values of common electrodes can be determined according to the probability principle of the normal distribution. A mathematical expectation $\mu$ and a standard deviation $\sigma$ of the optimized voltage values of common electrodes are counted. As shown in FIG. 5, a normal distribution curve of the optimized voltage values of common electrodes in a range ($\mu-3\sigma$, $\mu+3\sigma$), the probabilities of the optimized voltage values of common electrodes that respectively appear in the four ranges ($\mu-\sigma$, $\mu+\sigma$), ($\mu-2\sigma$, $\mu+2\sigma$), ($\mu-3\sigma$, $\mu+3\sigma$), ($\mu-4\sigma$, $\mu+4\sigma$) are counted. A shown in FIG. 6, as the range ($\mu-3\sigma$, $\mu+3\sigma$) is selected, 99.73% of the optimized voltage values of common electrodes fall in this range which can guarantee that the optimized voltage values of common electrodes for most of the liquid crystal panel fall in this initial setting range. The practical effect is shown in FIG. 7.

Figure 2:
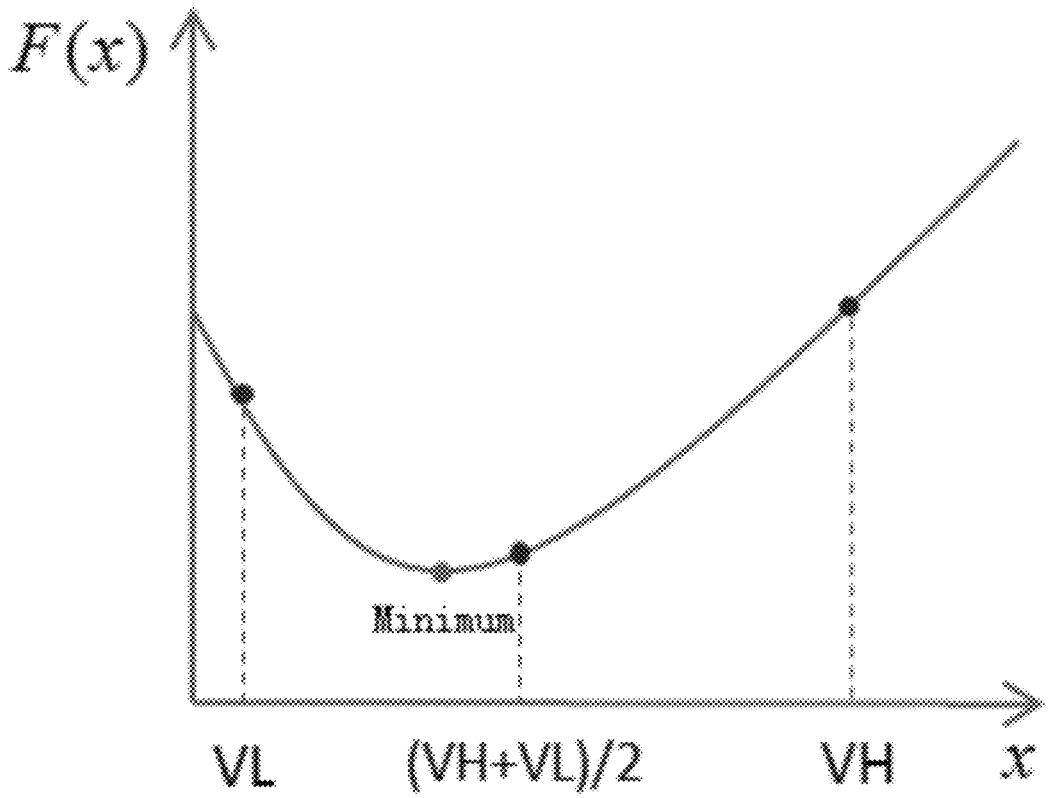
FIG. 2 is a curve diagram of the flick value and the voltage value of common electrode.

Step 4, showing a flicker image, and writing VH, VL, (VH+VL)/2 into a random access memory of the Nth liquid crystal panel one by one, and measuring corresponding flicker values;

Step 5, determining whether the flicker value corresponding to (VH+VL)/2 is a minimum among the three flicker values in the Step 4; if it is not the minimum, the Nth liquid crystal panel is an abnormal panel to be screened out, and adjustment is accomplished; if it is the minimum, the adjustment is proceeded;

As shown in FIG. 2, a curve diagram of the flick value and the voltage value of common electrode combines the principle of mean value theorem. The flicker values of the two end points and the middle point of the initial range are measured. If the flicker value corresponding to (VH+VL)/2 is not the minimum among the three flicker values in the Step 4, the optimized voltage value of common electrode corresponding to the minimum flicker value of the liquid crystal panel is determined not in the set initial range (VL, VH). The liquid crystal panel which is not in the determined initial range should be a flicker abnormal panel to be screened out. The adjustment is accomplished.

If the flicker value corresponding to (VH+VL)/2 is the minimum among the three flicker values in the Step 4, the optimized voltage value of common electrode corresponding to the minimum flicker value of the liquid crystal panel is determined in the set initial range (VL, VH). The following Steps 6, 7 are proceeded.

Step 6, writing the voltage values of common electrodes in the initial range (VL, VH) into the random access memory of the Nth liquid crystal panel one by one and from low to high, and measuring corresponding flicker values;

Step 7, selecting a voltage value of common electrode corresponding to a minimum of the flicker values to be written into a read only memory (ROM) of the Nth liquid crystal panel, and the adjustment is accomplished.

In the practical production, the initial range $6\sigma$ of adjusting the voltage of common electrode set in the present invention is about 18 units of the voltage of common electrode. However, without the method of the present invention but directly selecting all effective ranges of the voltages of common electrodes to implement the adjustment, the initial range of adjusting the voltage of common electrode is about 120 units of the voltage of common electrode. Therefore, in comparison with prior arts, the present invention can reduce 80% of the required flicker adjustment time. The production efficiency is significantly raised. Meanwhile, with the constant improvement of the process, the optimized voltage value of common electrode is tending towards stability, i.e. a is decreasing and the adjustment range is narrowed, too. The required time for the flicker adjustment is reduced in advance and the improvement is getting more obvious; except saving the adjustment time, the present invention is capable of quickly screening out the panels with abnormal flicker.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A method of adjusting flicker of a liquid crystal panel, comprising:

step 1, providing a Nth liquid crystal panel to be implemented with flicker adjustment, and providing optimized voltage values of common electrodes of 1st to N−1th liquid crystal panels, and the variable N is an integer larger than 10;

step 2, counting a mathematical expectation $\mu$ and a standard deviation $\sigma$ of the optimized voltage values of common electrodes of 1st to N−1th liquid crystal panels;

step 3, setting an initial range (VL, VH) of adjusting voltage values of common electrodes, and the initial range is determined by a principle of normal distribution, wherein $VL=\sigma-M\sigma$, $VH=\mu+M\sigma$, and M is a positive integer;

step 4, showing a flicker image, and writing VH, VL, (VH+VL)/2 into a random access memory of the Nth liquid crystal panel one by one, and measuring corresponding flicker values;

step 5, determining whether the flicker value corresponding to (VH+VL)/2 is a minimum among the three flicker values in the fourth step; if it is not the minimum, the Nth liquid crystal panel is an abnormal panel to be screened out, and adjustment is accomplished; if it is the minimum, the adjustment is proceeded;

step 6, writing the voltage values of common electrodes in the initial range (VL, VH) into the random access memory one by one and from low to high, and measuring corresponding flicker values;

step 7, selecting a voltage value of common electrode corresponding to a minimum of the flicker values in the sixth step to be written into a read only memory of the Nth liquid crystal panel, and the adjustment is accomplished.

2. The method of adjusting flicker of the liquid crystal panel according to claim 1, wherein the 1st to Nth liquid crystal panels in the first step are same model.

3. The method of adjusting flicker of the liquid crystal panel according to claim 1, wherein the fifth step is proceeded according to mean value theorem.

4. The method of adjusting flicker of the liquid crystal panel according to claim 1, wherein the first step of providing the optimized voltage values of common electrodes of the 1st to N−1th liquid crystal panels comprises: sequentially implementing flicker adjustment to the 1st to N−1th liquid crystal panels, and directly selecting all effective ranges to be sequentially written into a random access memory of a common electrode voltage chip of a liquid crystal panel from low to high as implementing adjustment to each of the liquid crystal panels, and measuring one flicker value as writing each of voltage values of common electrodes, and selecting a voltage value of common electrode corresponding to a minimum of all the flicker values to be written into a read only memory of the common electrode voltage chip of the liquid crystal panel.

5. The method of adjusting flicker of the liquid crystal panel according to claim 4, wherein the variable N in the first step is preferable to be an integer larger than 50.

6. The method of adjusting flicker of the liquid crystal panel according to claim 1, wherein the variable M in the third step is smaller than 5.

7. The method of adjusting flicker of the liquid crystal panel according to claim 6, wherein the variable M in the third step is preferable to be 3.

8. A method of adjusting flicker of a liquid crystal panel, comprising:

step 1, providing a Nth liquid crystal panel to be implemented with flicker adjustment, and providing optimized voltage values of common electrodes of 1st to N−1th liquid crystal panels, and the variable N is an integer larger than 50;

step 2, counting a mathematical expectation $\mu$ and a standard deviation $\sigma$ of the optimized voltage values of common electrodes of 1st to N−1th liquid crystal panels;

step 3, setting an initial range (VL, VH) of adjusting voltage values of common electrodes, and the initial range is determined by a principle of normal distribution, wherein $VL=\mu-M\sigma$, $VH=\mu+M\sigma$, and M is a positive integer smaller than 5;

step 4, showing a flicker image, and writing VH, VL, (VH+VL)/2 into a random access memory of the Nth liquid crystal panel one by one, and measuring corresponding flicker values;

step 5, determining whether the flicker value corresponding to (VH+VL)/2 is a minimum among the three flicker values in the fourth step; if it is not the minimum, the Nth liquid crystal panel is an abnormal panel to be screened out, and adjustment is accomplished; if it is the minimum, the adjustment is proceeded;

step 6, writing the voltage values of common electrodes in the initial range (VL, VH) into the random access memory one by one and from low to high, and measuring corresponding flicker values;

step 7, selecting a voltage value of common electrode corresponding to a minimum of the flicker values in the sixth step to be written into a read only memory of the Nth liquid crystal panel, and the adjustment is accomplished;

wherein the 1st to Nth liquid crystal panels in the first step are same model;

wherein the fifth step is proceeded according to mean value theorem;

wherein the first step of providing the optimized voltage values of common electrodes of the 1st to N−1th liquid crystal panels comprises:

sequentially implementing flicker adjustment to the 1st to N−1th liquid crystal panels, and directly selecting all effective ranges to be sequentially written into a random access memory of a common electrode voltage chip of a liquid crystal panel from low to high as implementing adjustment to each of the liquid crystal panels, and measuring one flicker value as writing each of voltage values of common electrode, and selecting a voltage value of common electrode corresponding to a minimum of all the flicker values to be written into a read only memory of the common electrode voltage chip of the liquid crystal panel.

* * * * *